US006039415A

United States Patent [19]

Bruun

[11] Patent Number: 6,039,415

[45] Date of Patent: Mar. 21, 2000

[54] WATER RESISTANT FILE CABINETS

[76] Inventor: Anders Bruun, 239 Aubert Street, Winnipeg Manitoba, Canada, R2H 3G8

[21] Appl. No.: 09/034,240

[22] Filed: Mar. 4, 1998

[51] Int. Cl.[7] ..... A47B 81/00

[52] U.S. Cl. ..... 312/229; 312/100

[58] Field of Search ..... 312/100, 229, 312/348.4, 216, 222; 52/97; 11/716.2

[56] References Cited

U.S. PATENT DOCUMENTS

| | | | |
|---|---|---|---|
| 2,320,556 | 6/1943 | Belshaw | 312/229 X |
| 2,514,001 | 7/1950 | Knuth | 312/229 X |
| 3,645,594 | 2/1972 | Cintz | 312/229 X |
| 4,289,361 | 9/1981 | Riedel | 312/229 X |
| 4,810,025 | 3/1989 | Riley | 52/97 X |
| 4,909,006 | 3/1990 | Hickman et al. | 52/716.2 X |
| 4,949,218 | 8/1990 | Blanchard et al. . | |
| 5,161,870 | 11/1992 | Mason et al. | 312/348.4 |
| 5,399,010 | 3/1995 | McClung et al. | 312/322 X |
| 5,435,641 | 7/1995 | Dupuis et al. . | |
| 5,476,316 | 12/1995 | Batroney et al. . | |
| 5,570,740 | 11/1996 | Flores et al. . | |
| 5,603,376 | 2/1997 | Hendrix . | |
| 5,676,418 | 10/1997 | Strefling | 52/97 X |

FOREIGN PATENT DOCUMENTS

| | | | |
|---|---|---|---|
| 2826020 | 12/1979 | Germany | 52/716.2 |

*Primary Examiner*—Peter M. Cuomo
*Assistant Examiner*—Hanh V. Tran
*Attorney, Agent, or Firm*—Michael R. Williams; Adrian Battison; Murray E. Thrift

[57] ABSTRACT

A series of design features which render filing and similar cabinets resistant to water entry are described. The design features may either be incorporated at the time of manufacture or retro-fitted onto certain types of existing cabinets. The features comprise water deflectors mounted above drawers or compartments of filing cabinets, the water deflectors having a downwardly sloping front face for deflecting falling water away from the drawers or compartments and flanges fitted onto the sides and bottom of the drawers or compartments, thereby eliminating any gaps between the frame of the filing cabinet and the drawers or compartments of the filing cabinet, which will in turn prevent water entry into the filing cabinet.

6 Claims, 4 Drawing Sheets

FIG. 3
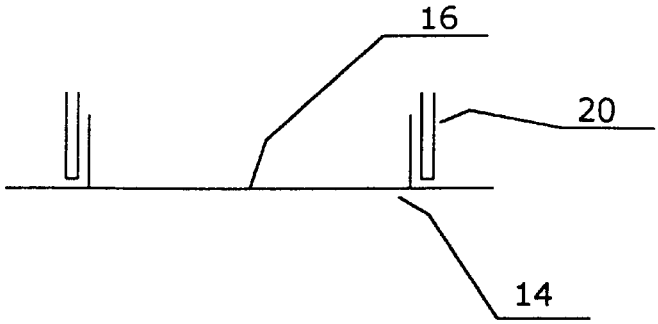
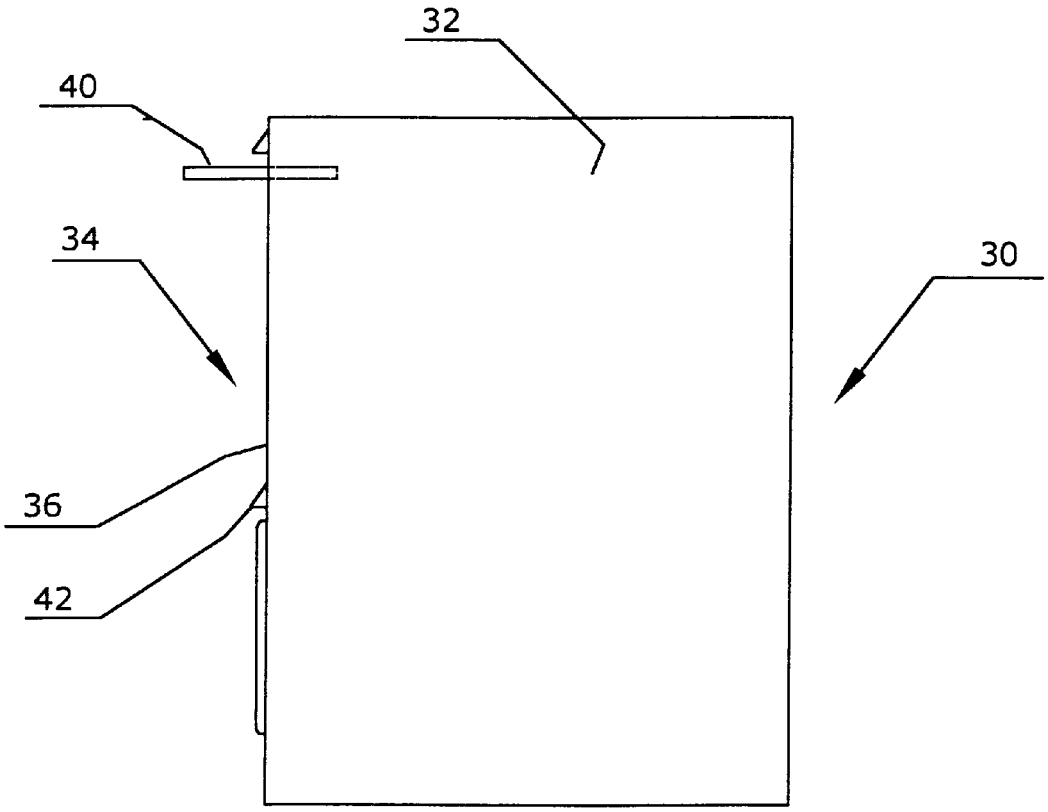
FIG. 4

FIG. 5
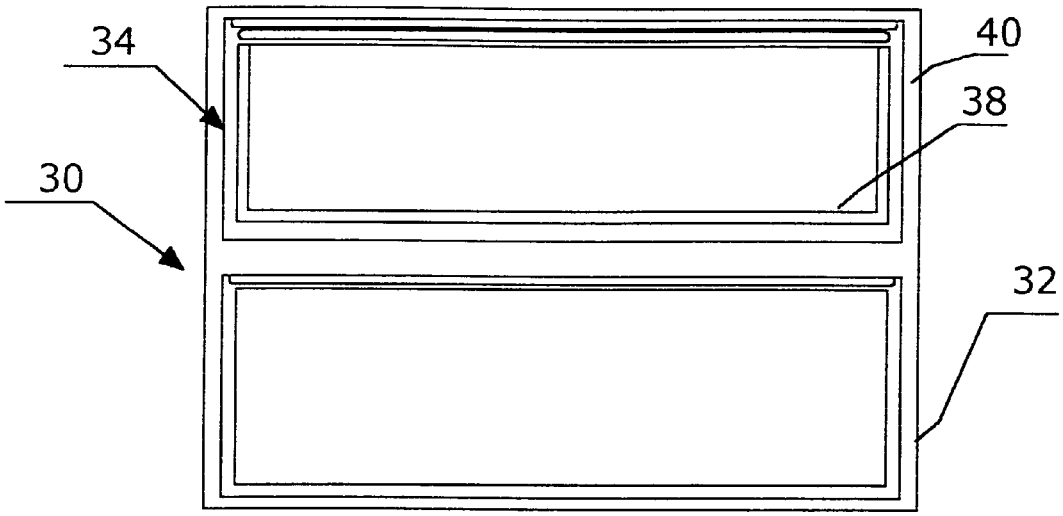
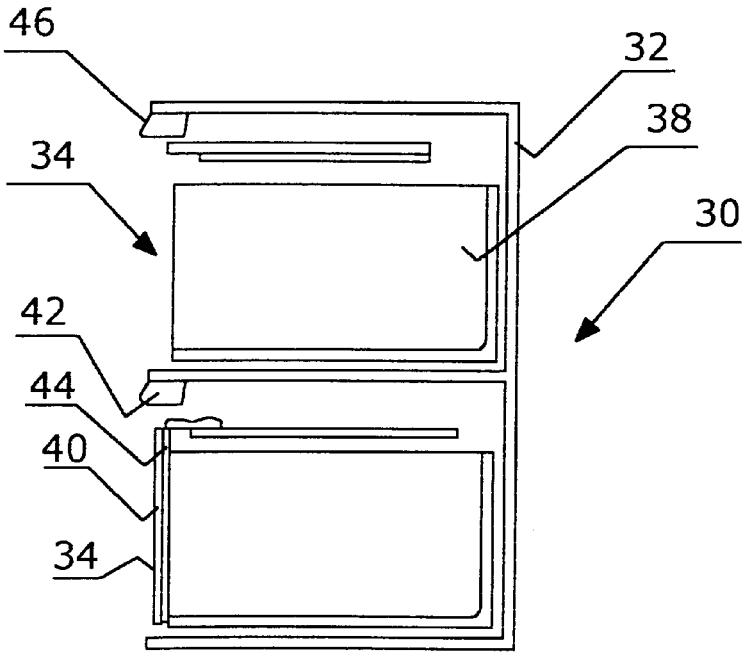
FIG. 6

WATER RESISTANT FILE CABINETS

The present invention relates to filing cabinets. More specifically, the present invention relates to water-resistant filing cabinets.

BACKGROUND OF THE INVENTION

Existing filing cabinet designs include gaps between the sliding drawer or flip-up door and the frame or body of the cabinet. Unfortunately, these gaps put the files within the filing cabinets at considerable risk. Specifically, water released from sources such as sprinkler systems, fire fighting equipment, leaky roofs and broken heating or plumbing ducts can infiltrate the filing cabinets through these gaps and damage the contents stored within the filing cabinets. Given that the documents stored therein may be irreplaceable, it is clear that water resistant filing cabinets are needed.

SUMMARY OF THE INVENTION

According to a first aspect of the invention, there is provided a cabinet comprising:

a substantially open front side;

at least one drawer mounted on the cabinet for sliding movement into and out of the open front side; and a water deflector extending across the front side of the cabinet above the drawer, said water deflector having a top face sloping downwardly away from the front of the cabinet.

The cabinet may have more than one drawer and more than one water deflector.

Preferably, the drawer has a front panel with flanges projecting from the edges of the front panel beyond the drawer to overlap adjacent faces of the cabinet.

Thus, in the above-described cabinet, there are no gaps between the sliding drawers and the frame of the cabinet and the water deflectors are positioned so as to direct water away from the drawers. As a result of this arrangement, the contents of the cabinet are protected from water damage.

According to a second aspect of the invention, there is provided a cabinet comprising:

at least one compartment having a substantially open front side;

at least one door mounted on the cabinet in front of the front side of the compartment, said door mounted for sliding movement into the cabinet and in front of the front side of the compartment; and a water deflector extending across the front side of the cabinet above the compartment, said water deflector having a top face sloping downwardly away from the front of the cabinet.

The cabinet may have more than one door, more than one compartment and more than one water deflector.

Preferably, the compartment has a front panel with flanges projecting from the edges of the front panel beyond the compartment to overlap adjacent faces of the cabinet.

Thus, in the above-described cabinet, there are no gaps between the compartments and the frame of the cabinet and the water deflectors are positioned so as to direct water away from the compartments. As a result of this arrangement, the contents of the cabinet are protected from water damage.

According to a third aspect of the invention, there is provided a kit for waterproofing storage compartments in a cabinet comprising:

a top panel for mounting onto the front panel of the cabinet above the storage compartments, said top panel having a top face arranged to slope downwardly away from the front of the cabinet; and means for mounting the top panel onto the cabinet.

Preferably, the kit includes water deflectors for mounting onto the cabinets adjacent to the edges of the storage compartments.

The kit may include flanges for mounting onto the storage compartments such that the flanges project from the edges of the drawer or the compartment.

Preferably, the top panels are arranged to snap together.

Thus, there is provided a series of features which may be incorporated individually or in combination into a filing cabinet, thereby resulting in a more water-resistant filing cabinet. Furthermore, a kit is also provided including the above-described components arranged to be fitted onto existing filing cabinets, thereby making an existing filing cabinet more water resistant. In either case, the end result is that the contents of the filing cabinet are protected from water damage.

Embodiments of the invention will now be described in conjunction with the accompanying drawings in which:

BRIEF DESCRIPTION OF THE FIGURES

FIG. 3 is a top view in cross-section of a water-resistant sliding drawer filing cabinet.

FIG. 4 is a side view of a water-resistant flip-up door filing cabinet.

FIG. 5 is a front view of a water-resistant flip-up door filing cabinet.

FIG. 6 is a side view in cross-section of a water-resistant flip-up door filing cabinet.

In the drawings like characters of reference indicate corresponding parts in the different figures.

DETAILED DESCRIPTION

Figure 2:
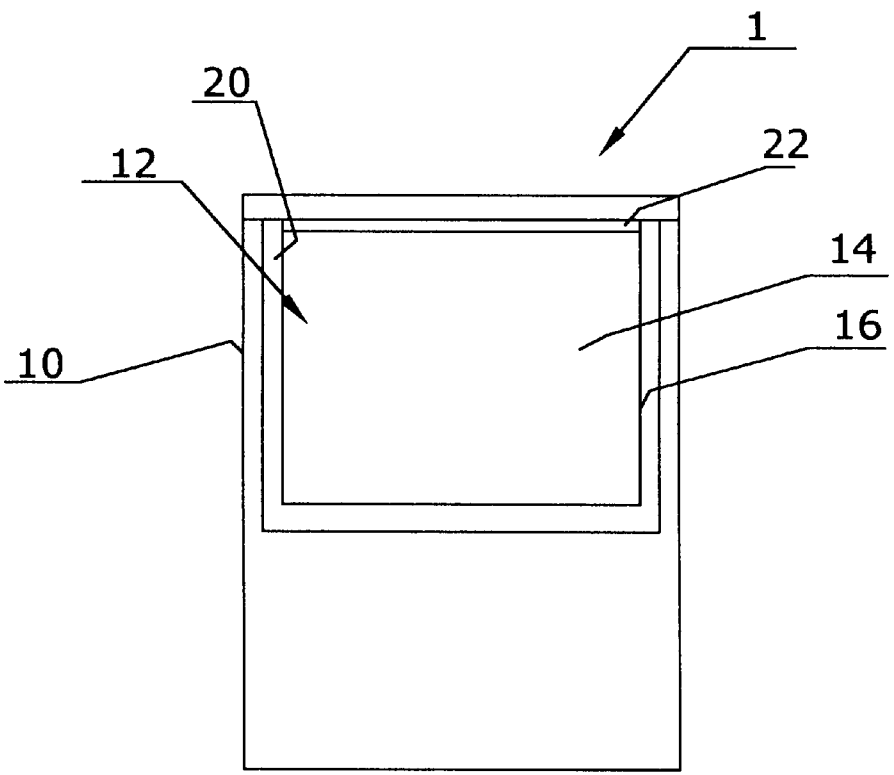
FIG. 2 is a front view of a water-resistant sliding drawer filing cabinet.
Figure 1:
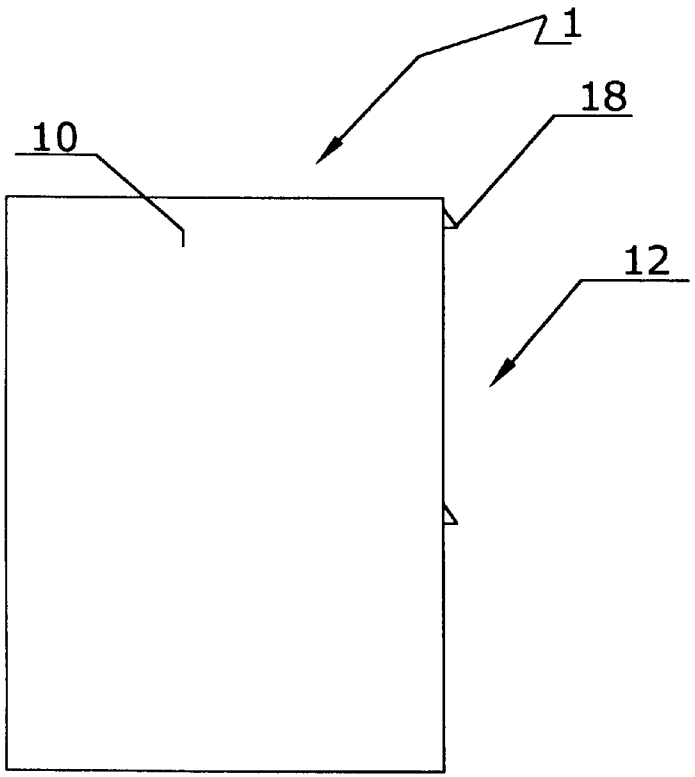
FIG. 1 is a side view of a water-resistant sliding drawer filing cabinet.

In one embodiment, there is provided a water-resistant sliding drawer filing cabinet 1 as shown in FIGS. 1–3.

The water-resistant sliding drawer filing cabinet 1 comprises a housing 10, a substantially open front side 12, a front panel 14 and drawers 16 mounted within the water-resistant sliding drawer filing cabinet 1 for sliding movement into and out of the open front side 12. As noted above, prior art filing cabinets include a gap between the sliding drawer 16 and the housing 10 which can allow water entry into the filing cabinet, thereby damaging the contents of the filing cabinet. The water-resistant sliding drawer filing cabinet 1 therefore includes water deflectors 18 and flanges 20. The water deflectors 18 are positioned above the drawers 16 and have a top face 22 sloping downwardly away from the front panel 14 of the water-resistant sliding drawer filing cabinet 1 as shown in FIG. 1. The flanges 20 project from the edges of the front panel 14 beyond the drawers 16 such that the flanges 20 overlap the front side 12 of the water-resistant filing cabinet 1, as shown in FIG. 3. Thus, the flanges 20 are positioned so that there is no gap between the drawers 16 and the front panel 12 of the water-resistant sliding drawer filing cabinet 1. As a result of the arrangement of the water deflectors 18 and the flanges 20, falling water is deflected away from the drawers 16 of the filing cabinet, thereby protecting the contents of the water-resistant filing cabinets 1.

In another embodiment, there is provided a water-resistant flip-up door filing cabinet 30 having inner compartments and sliding doors as shown in FIGS. 4–6.

The water-resistant flip-up door filing cabinet 30 comprises a housing 32, a substantially open front side 34, a front panel 36, compartments 38 for storing material therein and doors 40 mounted on the water-resistant flip-up door filing cabinet. 30 in front of the individual compartments 38, the doors 40 mounted for sliding movement into the water-resistant flip-up door filing cabinet 30 and in front of the compartments 38. As noted above, prior art filing cabinets include a gap between the doors 40 and the housing 32 which can allow water entry into the filing cabinet, thereby damaging the contents of the filing cabinet. The water-resistant flip-up door filing cabinet 30 therefore includes water deflectors 42 and flanges 44. The water deflectors 42 are positioned above the individual compartments 38 and have a top face 46 sloping downwardly away from the front side 34 of the water-resistant flip-up door filing cabinet 30 as shown in FIG. 4. The flanges 44 project from the edges of the compartments 38 to overlap the front panel 36 of the water-resistant flip-up door filing cabinet 30, as shown in FIG. 6. As a result of this arrangement of the flanges 44 and the water deflectors 42, falling water is deflected away from the compartments 38 of the water-resistant flip-up door filing cabinet 30, thereby preventing water damage to the contents of the water-resistant flip-up door filing cabinet 30.

Figure 7:
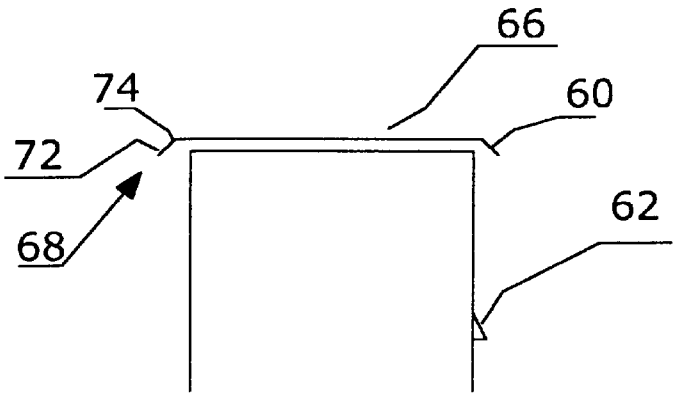
FIG. 7 is a side view of a filing cabinet arranged to include components of the kit for water-proofing filing cabinets.
Figure 8:
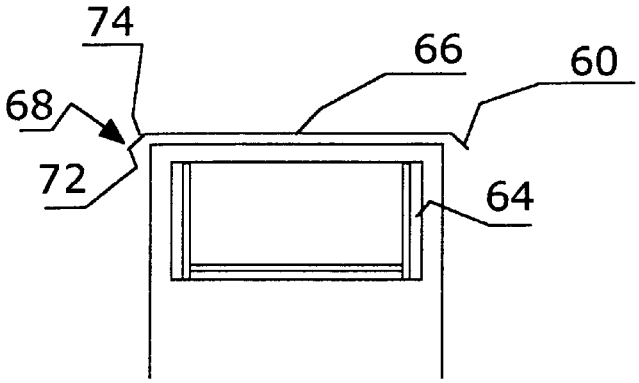
FIG. 8 is a front view of a filing cabinet arranged to include components of the kit for water-proofing filing cabinets.
Figure 9:
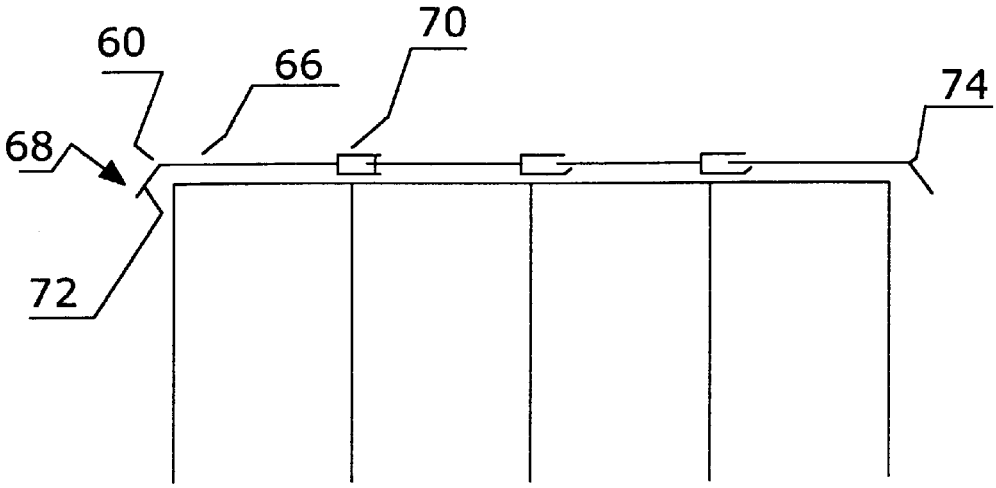
FIG. 9 is a front view of multiple filing cabinets interconnected by components of the kit for water-proofing filing cabinets.

In yet another embodiment, there is provided a kit comprising top panels 60, water deflectors 62 and flanges 64 arranged to be mounted onto filing cabinets for water-proofing the filing cabinets. The top panels 60 comprise a cap portion 66 arranged to be fitted over the top of a filling cabinet and overhang portions 68 arranged to slope downwardly away from the cap portion 66, the overhang portions 68 being located on all four sides of the cap portion 66 as shown in FIG. 7. Thus, the overhang portions 68 will act to deflect falling water away from the filing cabinet. The kit further includes connecting means 70 for inter-connecting adjacent top panels 60 and thereby connecting adjacent filing cabinets as shown in FIG. 9. The water deflectors 62 comprise a front face 72 arranged to slope downwardly away from a top portion 74 of the water deflector 62 and include mounting means for mounting the water deflectors 62 above a drawer or compartment of a filing cabinet. As a result of this arrangement, the water deflectors 62 will direct water away from the drawers or compartments, thereby preventing the contents of the filing cabinet from being damaged by the water. The flanges 64 are arranged to attach to the sides and bottom of a drawer or compartment by mounting means as shown in FIG. 8. Thus, the flanges 64 are arranged to be inserted into the gap between the drawers or compartments of a filing cabinet and the housing. In this embodiment, the flanges 64 comprise a flat formed strip. Thus, the flanges 64 and the water deflectors 62 are arranged to prevent water entry into the filing cabinet, thereby protecting the contents of the filing cabinet from water damage. It is of note that the mounting means for the flanges 64 and the water deflectors 62 may comprise an adhesive strip or screws. In this manner, the kit may be used to water-proof a filing cabinet.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

What is claimed is:

1. A filing cabinet comprising:

a housing with at least one compartment having a substantially open front side;

at least one door mounted on the housing for sliding and pivoting movement between an open position extending into the cabinet at the top of the compartment and a closed position extending across the open front side of the compartment;

a water deflector extending across the cabinet immediately above the open front side of the compartment and immediately above the door, said water deflector having a top face sloping downwardly and forwardly from the front side of the compartment and beyond the door when the door is in the closed position, whereby water falling on the cabinet is deflected away from the front panel of the drawer; and flanges projecting from edges of the compartment overlapping adjacent faces of the door in the closed position of the door whereby water is prevented from entering the open front side of the compartment.

2. The cabinet according to claim 1 having a plurality of compartments, a plurality of doors, and a plurality of water deflectors, each water deflector extending across the front side of the housing above a respective one of the compartments.

3. A filing cabinet comprising:

a housing with a substantially open front side;

a plurality of drawers, each of the drawers mounted on the cabinet for sliding movement into and out of the front side between an open position extending out of the front side of the cabinet and a closed position within the cabinet, each of the drawers having a front panel extending across the open front side of the housing in the closed position of each of the drawers;

a plurality of water deflectors, each of the water deflectors extending across the front side of the housing above the front panel of a respective one of the drawers, each of the water deflectors having a top face sloping downwardly and forwardly from the front side of the housing and beyond the front panel of the respective one of the drawers when the respective one of the drawers is in the closed position, whereby water falling on the cabinet is deflected away from the front panel of each of the drawers; and flanges projecting from edges of the front panels of the drawers and overlapping adjacent faces of the cabinet in the closed positions of the drawers whereby water is prevented from entering the open front side of the cabinet.

4. A kit for preventing water falling on a filing cabinet from entering the filing cabinet, said filing cabinet comprising a housing having a top, a plurality of compartments with open front sides and panels closing the open front sides of the compartments, said kit comprising:

a top panel having a cap portion to be fitted over the top of the housing above the compartments, and at least one overhang portion extending from the cap portion to slope downwardly away from the housing;

water deflectors for mounting onto the housing above respective ones of the compartments; and a plurality of flanges for mounting on the filing cabinet to overlap edges of the panels and adjacent portions of the cabinet.

5. A kit according to claim 4 including a plurality of top panels and connecting means for inter-connecting adjacent ones of the top panels edge to edge to be fitted over tops of plural adjacent filing cabinets.

6. A kit according to claim 4 wherein the top panel has a plurality of overhang portions extending from respective sides of the cap portion.

* * * * *